US009239166B2

(12) United States Patent
Caron et al.

(10) Patent No.: US 9,239,166 B2
(45) Date of Patent: Jan. 19, 2016

(54) GAS TURBINE DIFFUSER WITH FLOW SEPARATOR

(71) Applicant: Solar Turbines Incorporated, San Diego, CA (US)

(72) Inventors: Timothy James Caron, San Diego, CA (US); Peter J. Skyes, Encinitas, CA (US); Christopher J. Meyer, San Diego, CA (US); Federico Liberatore, San Diego, CA (US)

(73) Assignee: Solar Turbines Incorporated, San Diego, CA (US)

( * ) Notice: Subject to any disclaimer, the term of this patent is extended or adjusted under 35 U.S.C. 154(b) by 337 days.

(21) Appl. No.: 13/663,133

(22) Filed: Oct. 29, 2012

(65) Prior Publication Data

US 2014/0116056 A1 May 1, 2014

(51) Int. Cl.
*F23R 3/26* (2006.01)
*F23R 3/04* (2006.01)

(52) U.S. Cl.
CPC ... *F23R 3/26* (2013.01); *F23R 3/04* (2013.01); *F23R 2900/00016* (2013.01); *Y10T 29/49323* (2015.01)

(58) Field of Classification Search
CPC .... F23R 3/04; F23R 3/26; F23R 2900/00016; F05D 2270/17; F04D 29/681; Y10S 415/914; B64C 21/00; B64C 21/10; B64C 2003/148; F15D 1/003; F15D 1/004; F15D 1/0045; F15D 1/009
USPC ..... 60/751; 415/914
See application file for complete search history.

(56) References Cited

U.S. PATENT DOCUMENTS

| | | | | |
|---|---|---|---|---|
| 3,289,921 | A * | 12/1966 | Soo | 415/207 |
| 3,364,678 | A * | 1/1968 | Alford | F23R 3/002 60/751 |
| 3,625,630 | A * | 12/1971 | Soo | 415/207 |
| 4,098,073 | A * | 7/1978 | Adkins et al. | 60/791 |
| 4,272,955 | A * | 6/1981 | Hoffman et al. | 60/804 |
| 4,380,895 | A * | 4/1983 | Adkins | 60/39.23 |
| 5,494,438 | A * | 2/1996 | Yang | 431/350 |
| 5,632,141 | A * | 5/1997 | Sloop et al. | 60/782 |
| 5,737,915 | A | 4/1998 | Lin et al. | |
| 6,484,971 | B2 * | 11/2002 | Layukallo | B64C 9/00 244/130 |
| 7,302,802 | B2 * | 12/2007 | Alkabie | 60/772 |
| 7,600,370 | B2 | 10/2009 | Dawson | |
| 7,984,614 | B2 | 7/2011 | Nolcheff | |
| 2012/0027578 | A1 | 2/2012 | Nanda | |

OTHER PUBLICATIONS

Walker, Experimental and Computational Study of Hybrid Diffusers for Gas Turbine Combustors (2002), A.D. Walker.*
Juhasz and Smith, Performance of High-Area-Ratio Annular Dump Diffuser Using Suction-Stabilized-Vortex Flow Control (1977), National Aeronautics and Space Administration, NASA TM X-3535.*

* cited by examiner

*Primary Examiner* — William H Rodriguez
*Assistant Examiner* — Jason H Duger
(74) *Attorney, Agent, or Firm* — Procopio, Cory, Hargreaves & Savitch LLP

(57) ABSTRACT

A diffuser for use in a gas turbine engine, the diffuser having a first wall, a second wall, and a flow separator. The first and second wall define an annular cavity, with the annular cavity having an inlet. The first and second wall also forming a prediffuser that is proximate the inlet, and a dump region distal the inlet. The flow separator extends from the first wall into the annular cavity.

17 Claims, 4 Drawing Sheets

GAS TURBINE DIFFUSER WITH FLOW SEPARATOR

TECHNICAL FIELD

The present disclosure generally pertains to gas turbine engines, and is more particularly directed toward a gas turbine diffuser.

BACKGROUND

Gas turbine engines include compressor, diffuser, combustor, and turbine sections. The diffuser reduces airflow velocity (conservation of mass) while increasing static pressure (Bernoulli's equation). The diffuser also provides air to the combustor for the combustion reaction. The diffuser assists in the proper control of the combustion process.

U.S. Pat. No. 7,984,614 issued to Nolcheff on Jul. 26, 2011 shows a plasma flow controlled diffuser system. In particular, the disclosure of Lin et al. is directed toward a diffuser system for a compressor for a gas turbine engine including a diffuser and a plasma actuator. The diffuser comprises a first wall and a second wall. The first and second walls form a diffuser flow passage there between. The plasma actuator is disposed at least partially proximate the second wall. The plasma actuator is adapted to generate an electric field to ionize a portion of air flowing through the flow passage.

The present disclosure is directed toward overcoming known problems and/or problems discovered by the inventors.

SUMMARY

A diffuser for use in a gas turbine engine, the diffuser having a first wall, a second wall, and a flow separator. The first and second wall define an annular cavity, with the annular cavity having an inlet. The first and second wall also forming a prediffuser that is proximate the inlet, and a dump region distal the inlet. The flow separator extends from the first wall into the annular cavity.

According to another embodiment, a method for retrofitting a diffuser in a gas turbine engine is also disclosed herein. The method includes removing a preexisting diffuser from a gas turbine engine, and installing a diffuser having forced flow separation into the gas turbine engine.

DETAILED DESCRIPTION

The systems and methods disclosed herein include a gas turbine engine diffuser with forced flow separation. In embodiments, the diffuser may be configured to separate the flow of air from an interior wall during operation. The air is separated prior to entering a rapidly expanding "dump region". Moreover, the diffuser may be configured such that the flow of air is forcibly and sufficiently separated to limit interaction at wall transitions, and to be subsequently be directed toward the feed of the injector.

Figure 1:
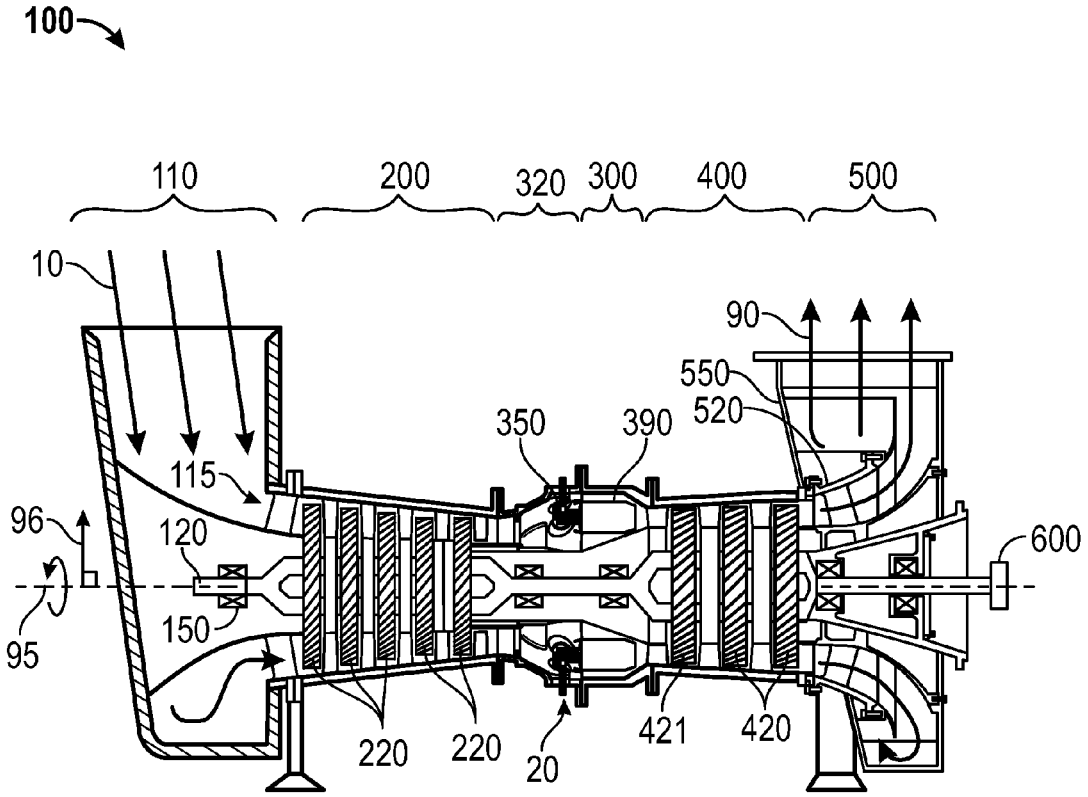
FIG. 1 is a schematic illustration of an exemplary gas turbine engine.

FIG. 1 is a schematic illustration of an exemplary gas turbine engine. Some of the surfaces have been left out or exaggerated (here and in other figures) for clarity and ease of explanation. Also, the disclosure may reference a forward and an aft direction. Generally, all references to "forward" and "aft" are associated with the flow direction of primary air (i.e., air used in the combustion process), unless specified otherwise. For example, forward is "upstream" relative to primary air flow, and aft is "downstream" relative to primary air flow.

In addition, the disclosure may generally reference a center axis of rotation of the gas turbine engine ("center axis" 95), which may be generally defined by the longitudinal axis of its shaft 120 (supported by a plurality of bearing assemblies 150). The center axis 95 may be common to or shared with various other engine concentric components. All references to radial, axial, and circumferential directions and measures refer to center axis 95, unless specified otherwise, and terms such as "inner" and "outer" generally indicate a lesser or greater radial distance from, wherein a radial 96 may be in any direction perpendicular and radiating outward from center axis 95.

Structurally, a gas turbine engine 100 includes an inlet 110, a gas producer or "compressor" 200, a diffuser 320, a combustor 300, a turbine 400, an exhaust 500, and a power output coupling 600. One or more of the rotating components are coupled by one or more shafts 120. The compressor 200 includes one or more compressor rotor assemblies 220. The combustor 300 includes one or more injectors 350 and includes one or more combustion chambers 390. The turbine 400 includes one or more turbine rotor assemblies 420. The exhaust 500 includes an exhaust diffuser 520 and an exhaust collector 550.

As illustrated, the diffuser 320 is located downstream of the compressor 200 and upstream of the combustor 300. According to one embodiment, the diffuser 320 mechanically interfaces between the compressor 200 and the combustor 300. In alternate embodiments, diffuser 320 may be integrated with the compressor 200, with the combustor 300, subdivided, or any combination thereof.

Functionally, a gas (typically air 10) enters the inlet 110 as a "working fluid", and is compressed by the compressor 200. In the compressor 200, the working fluid is compressed in an annular flow path 115 by the series of compressor rotor assemblies 220. In particular, the air 10 is compressed in numbered "stages", the stages being associated with each compressor rotor assembly 220. For example, "4th stage air" may be associated with the 4th compressor rotor assembly 220 in the downstream or "aft" direction—going from the inlet 110 towards the exhaust 500). Likewise, each turbine rotor assembly 420 may be associated with a numbered stage. For example, first stage turbine rotor assembly 421 is the forward most of the turbine rotor assemblies 420. However, other numbering/naming conventions may also be used.

Once compressed air 10 leaves the compressor 200, it enters the diffuser 320. The diffuser 320 is configured to diffuse the compressed air 10, and provide the air 10 to one or more injectors 350 and combustor liner in combustion chamber 390. Via the injector 350, air 10 and fuel 20 are injected into the combustion chamber 390 and ignited. After the combustion reaction, energy is then extracted from the combusted fuel/air mixture via the turbine 400 by each stage of the series of turbine rotor assemblies 420. Exhaust gas 90 may then be diffused in exhaust diffuser 520 and collected, redirected, and exit the system via an exhaust collector 550. Exhaust gas 90 may also be further processed (e.g., to reduce harmful emissions, and/or to recover heat from the exhaust gas 90).

One or more of the above components (or their subcomponents) may be made from stainless steel and/or durable, high temperature materials known as "superalloys". A superalloy, or high-performance alloy, is an alloy that exhibits excellent mechanical strength and creep resistance at high temperatures, good surface stability, and corrosion and oxidation resistance. Superalloys may include materials such as HASTELLOY, INCONEL, WASPALOY, RENE alloys, HAYNES alloys, INCOLOY, MP98T, TMS alloys, and CMSX single crystal alloys.

Figure 2:
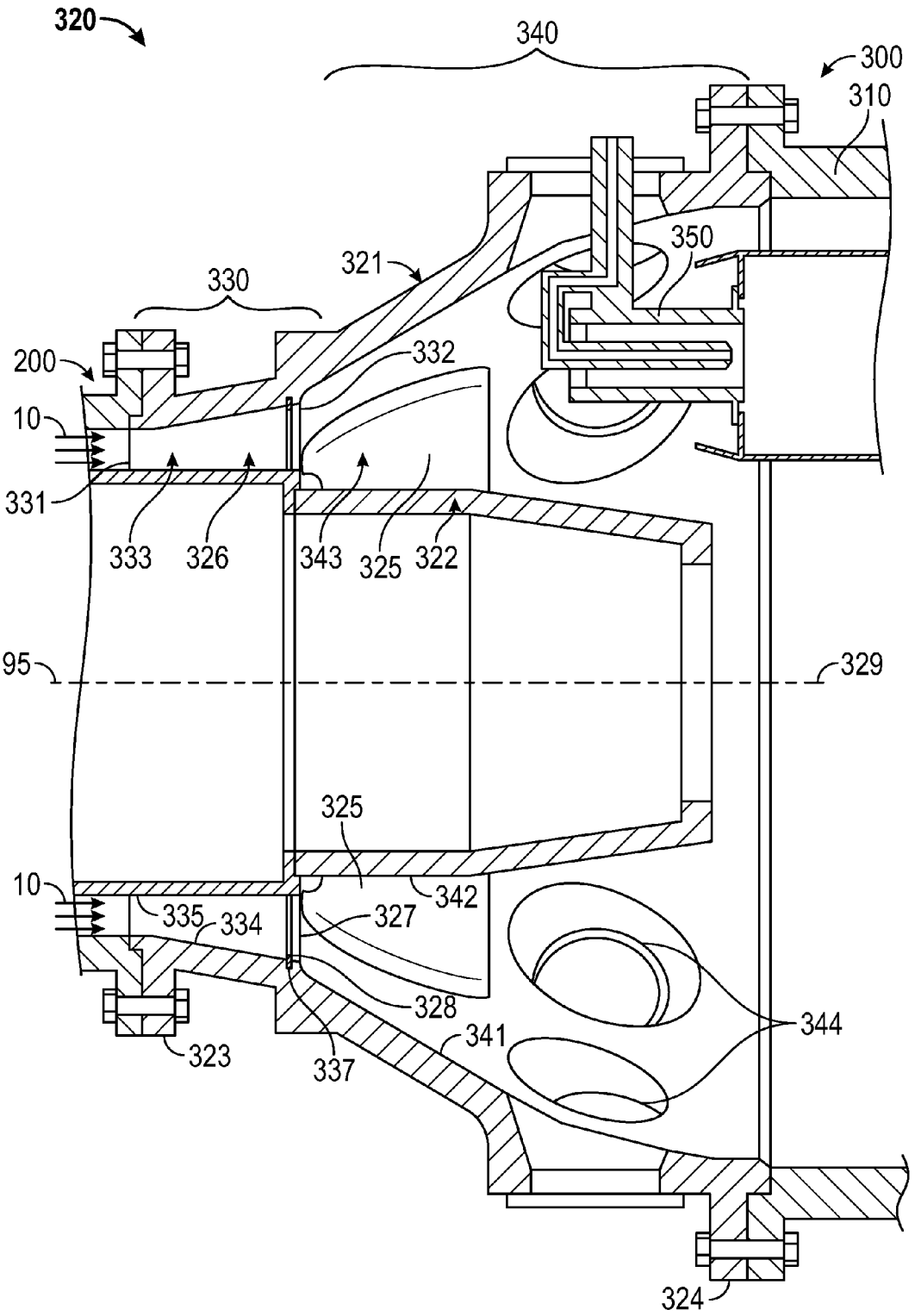
FIG. 2 is a cutaway side view of the diffuser from FIG. 1.

FIG. 2 is a cutaway side view of the diffuser from FIG. 1. In particular, diffuser 320 is shown slightly rotated about its own center axis 329 such that a diffuser strut 325 located at TDC (top dead center) is out-of-cut. Note, the center axis 329 of the diffuser 320 may be the same as the center axis 95 of the gas turbine engine, as illustrated here. Additionally, for clarity and illustration purposes, certain features/components have been added, removed, and/or simplified. For example, here, only one injector 350 is shown in the installed position within diffuser 320, with other injector ports 344 shown vacant. Also, mating mounting interfaces are shown.

The diffuser 320 structurally includes members such as an outer housing 321, an inner housing 322, a forward mounting interface 323, an aft mounting interface 324, and a plurality of diffuser struts 325. The inner and outer housings 321, 322 form an annular cavity 326 having an inlet, and through which air 10 passes. The inner and outer housings 321, 322 also form a prediffuser 330 and a dump region 340 discussed further below. The inner and outer housings 321, 322 may be singular structures, assembled structures, or a combination thereof. For example, portions of the inner and outer housings 321, 322 may be divided and/or shared for ease of manufacture and/or assembly. According to one embodiment, all or part of the inner and outer housings 321, 322 (as well as other members) may be cast as a single unit.

The forward mounting interface 323 may be configured to attach the diffuser 320 to one or more upstream structures, such as to the compressor 200. Similarly, the aft mounting interface 324 may be configured to attach the diffuser 320 to one or more downstream structures, such as to the combustor case 310. According to one embodiment, the forward mounting interface 323 and the aft mounting interface 324 may include circumferential flanges radiating radially away from the annular cavity 326, which then mount to mating interfaces using conventional means, such as a circumferential array of fasteners.

The plurality of diffuser struts 325 radially extend between at least a portion of the outer housing 321 and at least a portion of the inner housing 322, and are radially distributed around the annular cavity 326. The plurality of diffuser struts 325 support inner and outer housings 321, 322 relative to each other, and may include one or more radial passageways within each strut 325 configured to provide access to portions of the diffuser 320 that are radially inward of the inner housing 322. Accordingly, the one or more radial passageways (not shown) within each strut 325 provide a protected passage through the annular cavity 326. Although only two struts 325 are illustrated here, according to one embodiment, diffuser 320 may include seven struts 325.

The diffuser 320 functionally is a divergent duct, including both a prediffuser 330 and a dump region 340. The prediffuser 330 may be formed by upstream portions of the inner and outer housings 321, 322. Similarly, the dump region 340 may be formed by downstream portions of the inner and outer housings 321, 322. According to one embodiment, at least a portion of the prediffuser 330 may be formed by another component, such as the compressor 200. According to another embodiment, at least a portion of the dump region 340 may be formed by another component, such as an inner bearing housing or combustor 300.

The prediffuser 330 includes a prediffuser inlet 331, a prediffuser exit 332, and a prediffuser flowpath 333 there between. The prediffuser inlet 331 is the portion of the prediffuser 330 that first receives air 10 from the compressor 200, which may also serve as the diffuser inlet. The prediffuser exit 332 is the portion of the prediffuser 330 where air 10 leaves the prediffuser 330. The prediffuser flowpath 333 is the portion of the annular cavity 326 that is within the prediffuser 330.

Additionally, the prediffuser 330 includes a prediffuser outer wall 334 and a prediffuser inner wall 335. The prediffuser outer wall 334 may be formed by an inner surface of the outer housing 321. Similarly, the prediffuser inner wall 335 may be formed by an outer surface of the inner housing 322.

The prediffuser 330 is configured to diffuse compressed, high velocity air 10 exiting the compressor 200 in a stable and controlled manner. Aerodynamic considerations that may be important in the configuration of the prediffuser 330 may include a short flow path, a uniform flow distribution, and low drag loss. According to one embodiment, the prediffuser outer wall 334 and the prediffuser inner wall 335 may include machined finishes on surfaces exposed to air 10 (i.e., within the prediffuser flowpath 333).

According to another embodiment, the prediffuser 330 may expand on only one wall. In particular, one wall may run parallel with air while the other wall expands away from the first wall. For example, the prediffuser inner wall 335 may extend from the compressor, substantially parallel with the flow direction of air 10 in the prediffuser flowpath 333 at the prediffuser inlet 331. Meanwhile, the prediffuser outer wall 334 may form a frustum (i.e., a truncated cone with a linearly expanding radius) between the prediffuser inlet 331 and the prediffuser exit 332. Additionally, the outer may begin parallel with the prediffuser inner wall 335 for a transition distance, before expanding. In other embodiments, the prediffuser outer wall 334 may include a non-linear curvature along its axis. Similarly, the prediffuser inner wall 335 may include non-linear curvature along its axis. Moreover, the prediffuser inner wall 334 and outer wall 335 may both expand in radius with the only constraint being exit cross-sectional area is greater than inlet cross-sectional area.

The dump region 340 includes a dump region outer wall 341, a dump region inner wall 342, and an expansion cavity 343. Like in the prediffuser 330, the dump region outer wall 341 may be formed by an inner surface of the outer housing 321, and the dump region inner wall 342 may be formed by an outer surface of the inner housing 322.

The expansion cavity 343 is formed by the dump region outer wall 341 and the dump region inner wall 342, and intersected by the plurality of diffuser struts 325. The expansion cavity 343 is a portion of the annular cavity 326 rapidly expands once sufficient kinetic energy is recovered via the prediffuser 330. Compared to the prediffuser 330, the dump region 340 is less sensitive to aerodynamic considerations. For example, according to one embodiment, one or both of the dump region outer wall 341 and the dump region inner wall 342 may retain cast surfaces within the expansion cavity 343.

The diffuser 320 also includes a prediffuser-dump region interface 327 and a flow separator 328. The flow separator 328 is located proximate, but upstream from the prediffuser-dump region interface 327 and will be discussed further below. The prediffuser-dump region interface 327 is located between the prediffuser 330 and the dump region 340. In particular, the prediffuser-dump region interface 327 is the part of the diffuser 320 where the prediffuser 330 and the dump region 340 meet. The prediffuser-dump region interface 327 may include edges and/or discontinuities on both the outer housing 321 and the inner housing 322. In particular, the edges or discontinuities are located at the unions of the prediffuser outer wall 334 and the dump region outer wall 341, and/or at the prediffuser inner wall 335 and dump region inner wall 342, respectively.

As the diffuser 320 may be cast as a single unit, the prediffuser-dump region interface 327 may be identified by a transition in the outer housing 321 (and/or the inner housing 322) from a machine finish to a cast finish. Alternately, the prediffuser-dump region interface 327 may be identified by a substantial discontinuity in the rate of expansion of the annular cavity 326. The prediffuser exit 332 is the portion of the annular cavity 326 corresponding to the prediffuser-dump region interface 327.

The flow separator 328 is a member extending from prediffuser 330. The flow separator 328 is configured to cause airflow separation from at least one of the prediffuser outer wall 334 and the prediffuser inner wall 335. Additionally, the flow separator 328 may be configured to prevent the flow of air 10 from shifting during engine operation. In particular, the flow separator 328 extends into the prediffuser flowpath 333 from at least one of the prediffuser outer wall 334 and the prediffuser inner wall 335. According to one embodiment, the flow separator 328 may extend normally from the surface in which it is fixed, i.e., perpendicular to an angle of diffusion/expansion. Alternately, the flow separator 328 may extend normal to the center axis of the diffuser 320.

The flow separator 328 may be fixed to the prediffuser 330, and made of the same or a similar material as the prediffuser 330. In particular, the flow separator 328 may be integrated into the prediffuser 330, or may be added to and secured onto the prediffuser 330. For example, where the flow separator 328 is integrated into the prediffuser 330, it may be cast as a feature of the diffuser 320. As a cast feature, it may be subject to certain post-casting machine work, or finishing. Also for example, where the flow separator 328 is added and secured onto the prediffuser 330, it may be made from the same or similar material as the prediffuser 330 and joined to the prediffuser 330 through brazing or welding. As add-on member, the prediffuser 330 may first be subject to pre-joining machine work, or finishing to better receive the flow separator 328.

According to one embodiment, flow separator 328 may be made after an initial casting. In particular, the flow separator 328 may be added to the prediffuser 330. For example, once the diffuser 320 has been cast and finished, a receiving notch 337 may cut into the desired wall (here, the prediffuser outer wall 334) and the flow separator 328 may be inserted in the notch. Any convenient shape may be used for the receiving notch 337. For example here the receiving notch 337 has a rectangular shape matching that of a received end of the flow separator 328. Once the flow separator 328 is received in the receiving notch 337 it may be joined using conventional methods such as brazing or welding.

With this embodiment, a preexisting diffuser may be retrofit into the diffuser 320, having the flow separator 328. In particular, a preexisting diffuser may be machined to include a receiving notch 337, and a flow separator 328 may be added and joined. For example, as illustrated and as with a new manufacture, a prediffuser outer wall 334 of the preexisting diffuser may have receiving notch 337 machined into it. Then flow separator 328 may be inserted into the receiving notch 337. According to one embodiment, the flow separator 328 may be broken into two or more segments to facilitate installation. Additionally, according to one embodiment, the flow separator 328 may be press fit into the receiving notch 337.

Figure 3:
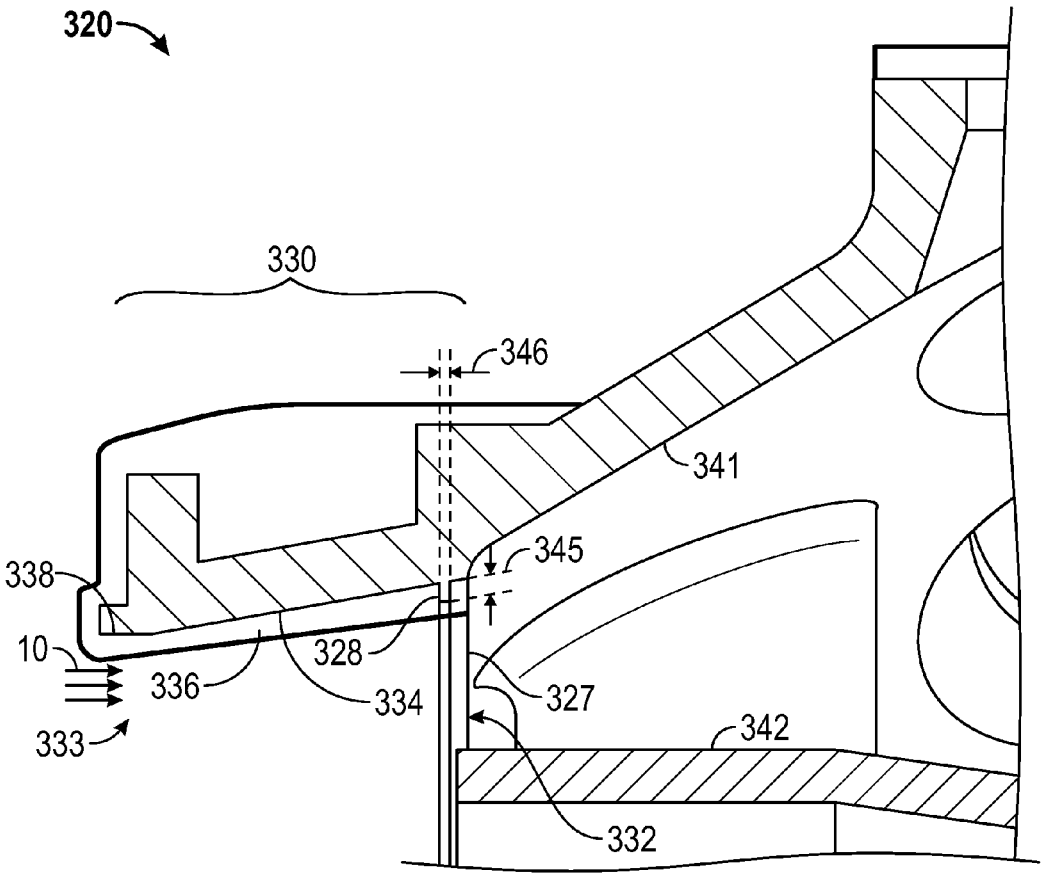
FIG. 3 is a schematic illustration superimposing both an uncut and cut state of the diffuser of FIG. 2.

FIG. 3 is a schematic illustration superimposing both an uncut and cut state of the diffuser of FIG. 2. In particular, the dark line represents the diffuser 320 after casting but before machine finishing is performed. This is to illustrate cutting the flow separator 328 directly out of the casting. As discussed above, there are multiple methods to make the flow separator 328, including but not limited to integrating it into the prediffuser 330 as part of a casting, or subsequently adding and secured it onto the prediffuser 330. Accordingly, FIG. 3 illustrates the former approach to making the flow separator 328. Note, in this embodiment the diffuser 320 is cast without the prediffuser inner wall 335 (FIG. 2).

Flow separator 328 may be made as part of an initial casting. In particular, the diffuser 320 may be cast with additional material in strategic locations to subsequently be machined off and form the flow separator 328. For example, in this embodiment, the diffuser 320 may include an excess cast layer 336 in the region of the prediffuser outer wall 334, as well as other surfaces to be machined. The excess cast layer 336 is illustrated by a darker line in the figure. The excess cast layer 336 is material cast in addition to any material to needed to finish the surface of the prediffuser outer wall 334. According to one embodiment the excess cast layer 336 includes sufficient excess casting material to machine the flow separator 328 into the diffuser 320 while in a cast or rough machined state. According to another embodiment the excess cast layer 336 is at least the thickness of the height 345 of the flow separator 328.

With the addition of the excess cast layer 336 the flow separator 328 may be directly integrated into the diffuser 320. In particular, the flow separator 328 may be formed by cutting away excess material of the excess cast layer 336. According to one embodiment, the flow separator 328 may be formed as part of a finish operation of the prediffuser outer wall 334. According to another embodiment, the flow separator 328 may be formed prior to a finish operation of the prediffuser outer wall 334. According to another embodiment, the flow separator 328 may be formed as part of a separate machining operation after a finish operation of the prediffuser outer wall 334.

The flow separator 328 forms an irregularity in the prediffuser flowpath 333. In particular, the flow separator 328 includes a profile that interrupts airflow around the annular cavity 326 near or at the prediffuser exit 332 during operation of the gas turbine engine. According to one embodiment the flow separator 328 may have a generally rectangular profile. In particular, when viewed radially as illustrated (side view), the flow separator 328 may include a height 345 and a width 346 in its profile, with the corresponding exposed (i.e., to air 10 during operation) surfaces joined at or about right angles.

In addition, the flow separator 328 may form a continuous, uninterrupted barrier. According to one embodiment, the flow separator 328 may include a member that circumscribes one or both of the prediffuser outer wall 334 and the prediffuser inner wall 335 (FIG. 2) and extends into the prediffuser flowpath 333. According to one embodiment, the circumscribed flow separator 328 may be angled such that it defines a plane or planar region, which is normal to the center axis 329 of the diffuser.

According to one embodiment the flow separator 328 may be configured to cause separation while minimizing losses. In particular, the flow separator 328 may be short, narrow, and have a sharp edge. For example, the flow separator 328 may have a short height, the height 345 only extending into the prediffuser flowpath 333 by ten percent, by less than ten percent, or between five and fifteen percent of the radial distance between the prediffuser outer wall 334 and the prediffuser inner wall 335 (FIG. 2). Alternately, the flow separator 328 may have a height 345 of 0.18", 0.1875" or less, or between 0.09" and 0.27". Also for example, the flow separator 328 may have a thickness or width 346, measuring in the axial direction, of 0.125" or less, or between 0.0625" and 0.25". Also for example, the flow separator 328 may have a sharp edge generally forming a right angle, with a generally rectangular profile (as described above) and/or having a thickness-to-height ratio of 0.7, less than 0.7, or between 0.6-0.8. Alternately, the flow separator 328 may have a sharp corner on its upstream face to induce clean flow separation, for example, the flow separator 328 may have a "break edge" requirement or leading corner radius <0.030".

According to one embodiment, the flow separator 328 may extend from only one of the prediffuser outer wall 334 and the prediffuser inner wall 335 (FIG. 2). In particular, where only one wall draws away from the flow of the air 10, the flow separator 328 may circumscribe only one of the prediffuser outer wall 334 and the prediffuser inner wall 335. Alternately, the flow separator 328 may extend from the wall having the highest velocity profile. Similarly, where one wall expands the prediffuser flowpath 333 at a greater rate than the other wall, the flow separator 328 may extend from that wall. For example, as illustrated here, the prediffuser inner wall 335 is substantially parallel with the flow direction of air 10, and the prediffuser outer wall 334 linearly expands between the prediffuser inlet 331 and the prediffuser exit 332 (with the exception of a transition region 338 proximate the prediffuser inlet 331). Thus, in this case the flow separator 328 may extend from the prediffuser outer wall 334.

According to one embodiment, the flow separator 328 may be located proximate the prediffuser-dump region interface 327. In particular, the flow separator 328 may be located at the prediffuser-dump region interface 327 or in the prediffuser 330 immediately upstream of the prediffuser-dump region interface 327.

For example, the flow separator 328 may be located at a distance of 1 times the width 346, less than 3 times the width 346, or between 0.5 times the width 346 and 4.5 times the width 346. Alternately, the flow separator 328 may be located at a distance from the prediffuser-dump region interface 327 selected such that, under normal operating conditions, the air 10 is prevented from attaching to the dump region outer wall 341 or the dump region inner wall 342. In addition, the flow separator 328 may be located at a distance from the prediffuser-dump region interface 327 selected such that, the air 10 is prevented from attaching to the dump region outer wall 341 or the dump region inner wall 342 under transient operating conditions.

INDUSTRIAL APPLICABILITY

Gas turbine engines, including stationary and motive gas turbine engines, and thus their components, may be suited for any number of industrial applications, such as, but not limited to, various aspects of the oil and natural gas industry (including include transmission, gathering, storage, withdrawal, and lifting of oil and natural gas), power generation industry, cogeneration, aerospace and transportation industry, to name a few examples.

Generally, embodiments of the presently disclosed gas turbine diffuser are applicable to the use, operation, maintenance, repair, and improvement of gas turbine engines, and may be used in order to improve performance and efficiency, decrease maintenance and repair, and/or lower costs. In addition, embodiments of the presently disclosed gas turbine diffuser may be applicable at any stage of the gas turbine engine's life, from design to prototyping and first manufacture, and onward to end of life. Accordingly, the gas turbine diffuser may be used in a first product, as a retrofit or enhancement to existing gas turbine engine, as a preventative measure, or even in response to an event. This is particularly true as the presently disclosed gas turbine diffuser may conveniently include identical interfaces to be interchangeable with a preexisting type of gas turbine diffuser.

Figure 4:
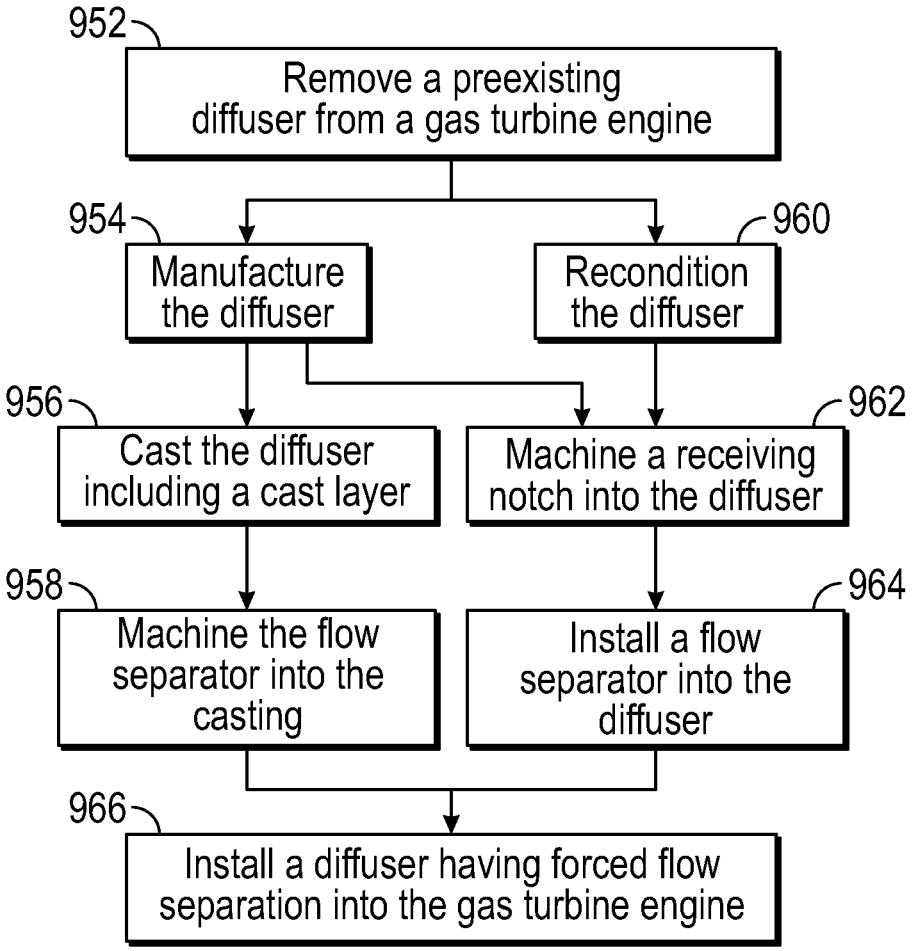
FIG. 4 is a flow chart of an exemplary method of retrofitting a diffuser in a gas turbine engine.

FIG. 4 is a flow chart of an exemplary method of retrofitting a diffuser in a gas turbine engine. In particular, the method corresponds to retrofitting the gas turbine engine with a diffuser 320 having forced flow separation. The method generally includes the steps of removing a preexisting diffuser from a gas turbine engine 952, and installing a diffuser having forced flow separation into the gas turbine engine 966.

The method may further include manufacturing the diffuser 954 or reconditioning the diffuser 960. As discussed in greater detail above, manufacturing the diffuser 954 may include casting the diffuser including an excess cast layer 956 and machining the flow separator into the casting 958. Alternately, the diffuser 954 may include machining a receiving notch into the diffuser 962 and installing a flow separator into the diffuser 964. Similarly, reconditioning the diffuser 960 may include machining a receiving notch into the diffuser 962 and installing a flow separator into the diffuser 964.

Once compressed air 10 leaves the compressor 200, it enters the diffuser 320. In the prediffuser 330 compressed, high velocity air 10 exiting the compressor 200 is diffused in a stable and controlled manner and then "dumped" in the dump region 340. The diffuser 320 is configured to diffuse the compressed air 10, and provide the air 10 to one or more injectors 350.

The one or more injectors 350 may be axially fed the diffused air 10. In particular, the one or more injectors 350 may have an axial feed arrangement of the swirler, where the feed of the airflow is directly into the dome of the injector 350. For example and as illustrated, the one or more injectors 350 may be "L shaped" lean premix axial flow injectors. Where the velocity profile of the air 10 entering the one or more injectors 350 varies sufficiently, engine performance and or emissions may be affected. Transient conditions however, are difficult to identify, let alone treat.

The inventor has discovered through extensive testing that the air 10 may attach to or otherwise be influenced by an expanding wall of the dump region 340 (here, the dump region outer wall 341) as it passes the prediffuser exit 332. In particular, flowpath variations and imperfections can lead to flowfield instabilities, separation zones and inconsistencies. Leakages downstream of the prediffuser 330 may also be influencing flow behavior. In addition, the flowfield may take on different "character" after load swing or shutdown/restart scenario. For example the boundary layer state may not be predictable (i.e., sometimes "attached" and sometimes not). Sufficient variation of the airflow may also affect NOx in the combustion process.

By separating the flow of air 10 from the expanding wall, prior to the prediffuser-dump region interface 327, greater resistance to transient conditions such as flow fluctuations induced by the dump region 340 may be achieved. In particular, the flow of air 10 may be separated so as to be directed toward the feed of the injector 350. Moreover, the flow separator 328 forcing flow to cleanly separate from the prediffuser 330 in a predictable and repeatable manner with the sharp edge or "trip strip" may mitigate any interaction the prediffuser 330 and the dump region 340 in the first instance.

The preceding detailed description is merely exemplary in nature and is not intended to limit the invention or the application and uses of the invention. The described embodiments are not limited to use in conjunction with a particular type of gas turbine engine. Hence, although the present embodiments are, for convenience of explanation, depicted and described as being implemented in a stationary gas turbine engine, it will be appreciated that it can be implemented in various other types of gas turbine engines, and in various other systems and environments. Furthermore, there is no intention to be bound by any theory presented in any preceding section. It is also understood that the illustrations may include exaggerated dimensions and graphical representation to better illustrate the referenced items shown, and are not consider limiting unless expressly stated as such.

What is claimed is:

1. A diffuser for use in a gas turbine engine, the diffuser comprising:

a first prediffuser wall;

a second prediffuser wall, the first prediffuser wall and the second prediffuser wall defining an annular cavity having an inlet and an outlet and defining an annular prediffuser airflow path from the inlet to the outlet, the first prediffuser wall and the second prediffuser wall diverging from the inlet to the outlet forming a prediffuser, the first prediffuser wall diverging in a downstream direction at a first angle relative to a diffuser center axis;

a dump region having a first dump region wall and a second dump region wall;

the first dump region wall extending from the first prediffuser wall at the outlet;

the first dump region wall and the second dump region wall defining an expansion cavity, the first dump region wall and the second dump region wall diverging as the expansion cavity extends from the outlet, the first dump region wall diverging in the downstream direction at a second angle relative to the diffuser center axis, wherein the second angle is greater than the first angle;

a flow separator extending radially from the first prediffuser wall into the annular cavity proximate and upstream of the outlet, the flow separator having a rectangular profile and extending into the annular prediffuser airflow path through the annular cavity to form a barrier facing the inlet which opposes an airflow along the first prediffuser wall, the flow separator is configured to separate the airflow from the first prediffuser wall before the airflow enters the dump region thereby creating a separated airflow, wherein neither the dump region nor the prediffuser include a vortex chamber or a bleed air port, located adjacent to the flow separator, used to influence the separated airflow adjacent to the barrier; and wherein the diffuser is configured for attachment to an upstream end of a combustor of the gas turbine engine.

2. The diffuser of claim 1, wherein the flow separator includes a height and a width; and wherein a ratio of the width to the height is between 0.6-0.8.

3. The diffuser of claim 1, further comprising a prediffuser-dump region interface between the prediffuser and the dump region; and wherein the flow separator is located proximate the prediffuser-dump region interface.

4. The diffuser of claim 1, wherein the flow separator is integrated into the prediffuser as part of a casting of the prediffuser.

5. The diffuser of claim 1, wherein the flow separator includes a height and a width; and wherein the height of the flow separator is between five and fifteen percent of a distance between the first prediffuser wall and the second prediffuser wall.

6. The diffuser of claim 5, wherein the width of the flow separator is between 0.0625" and 0.25".

7. The diffuser of claim 6, wherein the height of the flow separator is between 0.09" and 0.27"; and wherein the flow separator circumscribes at least one of the first prediffuser wall and the second prediffuser wall.

8. A combustor for use in a gas turbine engine, the combustor including the diffuser of claim 1.

9. A gas turbine engine including the diffuser of claim 1, wherein the gas turbine engine includes a compressor and a turbine; and wherein the diffuser is located downstream of the compressor and upstream of the turbine.

10. A diffuser for use in a gas turbine engine, the diffuser comprising:

a dump region including a dump region outer wall and a dump region inner wall defining an expansion cavity;

a prediffuser disposed upstream of the dump region, the prediffuser including a prediffuser outer wall and a prediffuser inner wall forming an annular airflow path with an inlet and an outlet, the prediffuser expanding from the inlet to the outlet, the prediffuser outer wall diverging in a downstream direction at a first angle relative to a diffuser center axis;

the dump region outer wall extending from the prediffuser outer wall at the outlet and diverging in the downstream direction at a second angle relative to the diffuser center axis, wherein the second angle is greater than the first angle;

a flow separator extending radially inward from the prediffuser outer wall into the annular airflow path and toward the prediffuser inner wall proximate and upstream of the dump region, the flow separator having a rectangular profile forming a barrier facing the inlet which opposes an airflow along the prediffuser outer wall and is configured to separate the airflow from the prediffuser outer wall before the airflow enters the dump region thereby creating a separated airflow, the flow separator is configured to direct the separated airflow towards the prediffuser outlet, wherein neither the dump region nor the prediffuser include either of: a vortex chamber or a bleed air port, located adjacent to the flow separator, used to influence the separated airflow adjacent to the barrier; and wherein the diffuser is configured for attachment to an upstream end of a combustor of the gas turbine engine.

11. The diffuser of claim 10, wherein the flow separator includes a height and a width; and wherein the flow separator is located upstream of the dump region by a distance less than 3 times the width of the flow separator.

12. The diffuser of claim 10, wherein the flow separator includes a height and a width; and wherein the flow separator is located upstream of the dump region by a distance between 0.5 times the width and 4.5 times the width of the flow separator.

13. A diffuser for use in a gas turbine engine, the diffuser comprising:

an outer housing including a prediffuser outer wall, and a dump region outer wall extending from the prediffuser outer wall;

an inner housing located within the outer housing, the inner housing including a prediffuser inner wall located inward from the prediffuser outer wall, the prediffuser inner wall and the prediffuser outer wall forming a prediffuser that includes an inlet and an outlet and defines an annular prediffuser airflow path from the inlet to the outlet, the prediffuser expanding from the inlet to the outlet, the prediffuser outer wall diverging in a downstream direction at a first angle relative to a diffuser center axis, and a dump region inner wall located inward from the dump region outer wall, the dump region inner wall and the dump region outer wall defining a dump region forming an expansion cavity extending from the prediffuser outlet, the dump region outer wall diverging in the downstream direction at a second angle relative to the diffuser center axis, wherein the second angle is greater than the first angle; and a flow separator extending radially into the annular prediffuser airflow path from the prediffuser outer wall towards the prediffuser inner wall, the flow separator being adjacent to and upstream of the dump region outer wall; and the flow separator having a rectangular profile forming a barrier which faces the inlet and opposes an airflow along the prediffuser outer wall and is configured to separate the airflow from the prediffuser outer wall thereby creating a separated airflow, the flow separator is configured to direct the separated airflow into the annular prediffuser airflow path prior to the separated airflow entering the dump region, wherein neither the dump region nor the prediffuser include either of: a vortex chamber or a bleed air port, located adjacent to the flow separator, used to influence the separated airflow adjacent to the barrier; and wherein the diffuser forms a portion of a combustor of the gas turbine engine.

14. The diffuser of claim 13, wherein the prediffuser outer wall forms a frustum between the inlet and the outlet, and wherein the prediffuser outer wall expands from the inlet to the outlet.

15. The diffuser of claim 13, wherein the prediffuser outer wall and the prediffuser inner wall include a machined finish, and wherein the dump region outer wall and the dump region inner wall include a cast finish.

16. The diffuser of claim 15, further comprising a prediffuser-dump region interface located at the outlet, wherein the outer housing transitions from the machined finish to the cast finish.

17. The diffuser of claim 13, wherein the outer housing includes a discontinuity in a rate of expansion between the prediffuser outer wall and the dump region outer wall.

* * * * *